US005766036A

United States Patent [19]

Ahmad et al.

[11] Patent Number: 5,766,036

[45] Date of Patent: Jun. 16, 1998

[54] IMPEDANCE MATCHED CABLE ASSEMBLY HAVING LATCHING SUBASSEMBLY

[75] Inventors: Munawar Ahmad, Conway; Ed Seamands, North Little Rock; Michael J. Miskin, Little Rock, all of Ark.; Paul Murphy, Naperville, Ill.

[73] Assignee: Molex Incorporated, Lisle, Ill.

[21] Appl. No.: 728,730

[22] Filed: Oct. 11, 1996

[51] Int. Cl.[6] ..... H01R 9/05

[52] U.S. Cl. ..... 439/578; 439/610; 439/936

[58] Field of Search ..... 439/578, 580, 439/582, 585, 736, 936, 98, 610, 606, 686, 695, 701

[56] References Cited

U.S. PATENT DOCUMENTS

| | | | |
|---|---|---|---|
| 4,491,381 | 1/1985 | Hamsher, Jr. et al. | 339/107 |
| 4,586,796 | 5/1986 | Tengler et al. | 359/59 |
| 4,898,548 | 2/1990 | Case et al. | 439/686 |
| 5,073,128 | 12/1991 | Sirai et al. | 439/585 |
| 5,120,241 | 6/1992 | Nakata et al. | 439/585 |
| 5,120,259 | 6/1992 | Nakata et al. | 439/585 |
| 5,145,409 | 9/1992 | Sato et al. | 439/585 |
| 5,184,965 | 2/1993 | Myschik et al. | 439/578 |
| 5,197,904 | 3/1993 | Gold | 439/581 |
| 5,441,424 | 8/1995 | Morlion et al. | 439/581 |

FOREIGN PATENT DOCUMENTS

| | | |
|---|---|---|
| A24010/88 | 10/1988 | Australia . |
| 284245-B1 | 1/1994 | European Pat. Off. . |
| 583934-A2 | 2/1994 | European Pat. Off. . |
| 654847-A1 | 5/1995 | European Pat. Off. . |
| 442643-B1 | 9/1995 | European Pat. Off. . |
| 01206580-A | 8/1989 | Japan . |
| 06333629-A | 12/1994 | Japan . |
| 06349532-A | 12/1994 | Japan . |
| 07022107-A | 1/1995 | Japan . |
| 2255863-B | 3/1995 | United Kingdom . |
| WO 9221166-A1 | 11/1992 | WIPO . |

*Primary Examiner*—Gary F. Paumen
*Attorney, Agent, or Firm*—A. A. Tirva

[57] ABSTRACT

A terminating connector for a data transmission cable, wherein the cable is of a known characteristic impedance and is of the type having a signal carrying conductor and a shield. The connector is typically arranged to mate with a complementary connector of a backplane. An overmolded subassembly of the connector includes a first terminal electrically coupled at one end thereof to the shield, and a second terminal electrically coupled at one end thereof to the signal carrying conductor. A dielectric insert is disposed between the first and second terminals. The insert is dimensioned and has a dielectric constant such that the characteristic impedance of the subassembly substantially matches the characteristic impedance of the cable. The subassembly also includes a latch mechanism for latching to a surrounding housing.

16 Claims, 3 Drawing Sheets

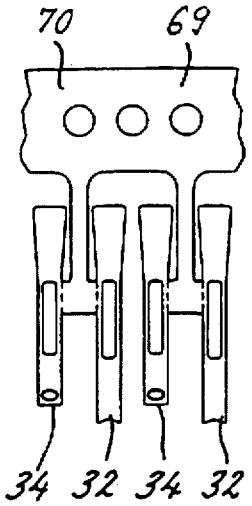
FIG. 6
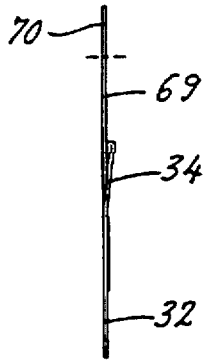
FIG. 7
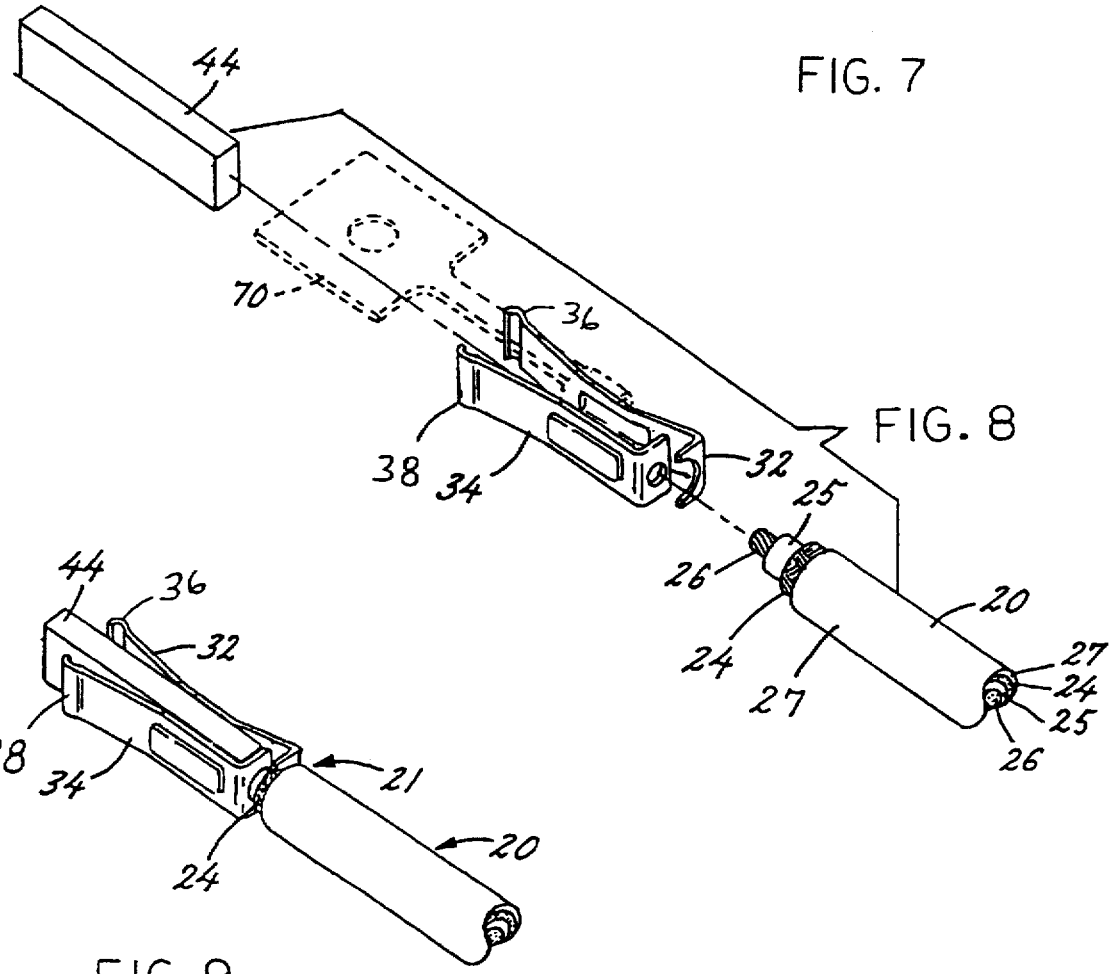
FIG. 8
FIG. 9

IMPEDANCE MATCHED CABLE ASSEMBLY HAVING LATCHING SUBASSEMBLY

TECHNICAL FIELD OF THE INVENTION

The present invention relates generally to electrical connectors used in high speed data transmission, and more particularly to a connector having improved impedance characteristics.

BACKGROUND OF THE INVENTION

When transmitting high speed data signals through a conductive transmission medium, the integrity of the received signals depends on the impedance over the signal path. In general, impedance mismatches in a transmission path cause signal reflection, which leads to signal losses such as reduction in signal amplitude, cancellation of certain signals, and so on. Accordingly, the more consistent the impedance over the path, the better the integrity of the received signal.

The wire portion of the conductive transmission medium, which, for example, may be a coaxial cable, provides a signal path having a very consistent characteristic impedance. Moreover, the physical construction of the wire allows the impedance to be selected, e.g., one cable may be constructed to have an impedance of 75 ohms, while another has an impedance of 50 ohms.

However, the terminating connector that connects the signal-carrying wire to the next destination for the signal is not well controlled with respect to impedance, and typically varies from the cable's impedance by a substantial amount. In particular, in a standard two millimeter connector assembly, the impedance of the connector is notorious for being poorly matched with the controlled-impedance cable that the connector is terminating. This reduces the integrity of signals received therethrough, resulting, for example, in numerous transmission errors and/or limited bandwidth.

OBJECTS AND SUMMARY OF THE INVENTION

Accordingly, it is an object of the present invention to provide an apparatus and method that improves the integrity of signal transmission by improving the impedance match between an electrical terminating connector and a data transmission cable terminated thereby.

It is a related object to provide a terminating connector that substantially matches the impedance of the cable.

Another object is to provide a connector as characterized above that is compatible in size and shape with standardized connector specifications.

Yet another object is to provide an apparatus of the above kind that employs a relatively simple and economical manufacturing method, while providing a sturdy and reliable connector.

Briefly, the present invention provides an apparatus for terminating a data transmission cable and a method for constructing same. The cable is of a known characteristic impedance and is of the type having a signal carrying conductor and a shield. The apparatus is embodied in a connector comprising a subassembly, the subassembly including a first terminal arranged for electrically coupling at one end to the shield. A first contact is disposed at the opposite end of the terminal. The subassembly further includes a second terminal arranged for electrically coupling at one end to the signal carrying conductor, and has a second contact at an opposite end thereof. A dielectric insert is disposed between the first and second terminals, the insert being dimensioned and having a selected dielectric constant to provide a characteristic impedance of the subassembly that substantially matches the characteristic impedance of the cable. The subassembly also includes a latch mechanism. A housing is provided, and has an interior region dimensioned to receive the subassembly from one end such that the first and second contacts are electrically accessible from an opposite end of the housing. The housing includes a complimentary latch mechanism in the interior region thereof for latching with the latch mechanism of the subassembly.

Other objects and advantages will become apparent from the following detailed description when taken in conjunction with the drawings, in which:

BRIEF DESCRIPTION OF THE DRAWINGS

FIG. 6 is a top view representative of stamped terminal portions for constructing the connector;

FIG. 7 is a side view of FIG. 9;

FIG. 8 is an exploded view illustrating a method of constructing the subassembly components;

FIG. 9 is a representation of the terminals with a dielectric insert therebetween and coupled to the cable prior to overmolding into a completed subassembly;

Figure 1:
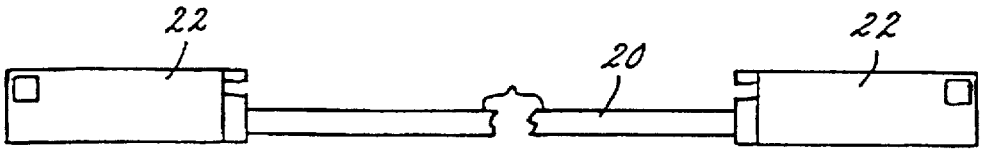
FIG. 1 is a side view illustrating a data transmission apparatus constructed according to the invention having a cable shown with terminating connectors at both ends thereof.

While the invention is amenable to various modifications and alternative constructions, certain illustrated embodiments thereof are shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENT

Figure 2:
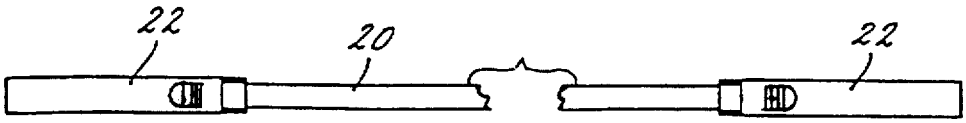
FIG. 2 is a top view of the apparatus of FIG. 1.

Turning to the drawings and referring first to FIGS. 1 and 2, there is shown a cable 20 having an electrical terminating connector generally designated 22 at each end thereof constructed in accordance with the invention. As best shown in FIG. 8, the cable 20 is of the type having a shield 24 and a signal carrying conductor 26, and has a known characteristic impedance, e.g., 50 ohms. A dielectric layer 25 electrically insulates the shield 24 from the signal carrying conductor 26, and a dielectric sheath 27 covers the shield 24. Such cables are typically used in high speed data transmission such as in telecommunications applications or applications involving the transmission of computer signals.

Figure 4:
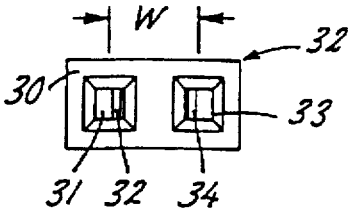
FIG. 4 is an end view illustrating apertures in the housing for providing electrical access to the terminals.
Figure 3:
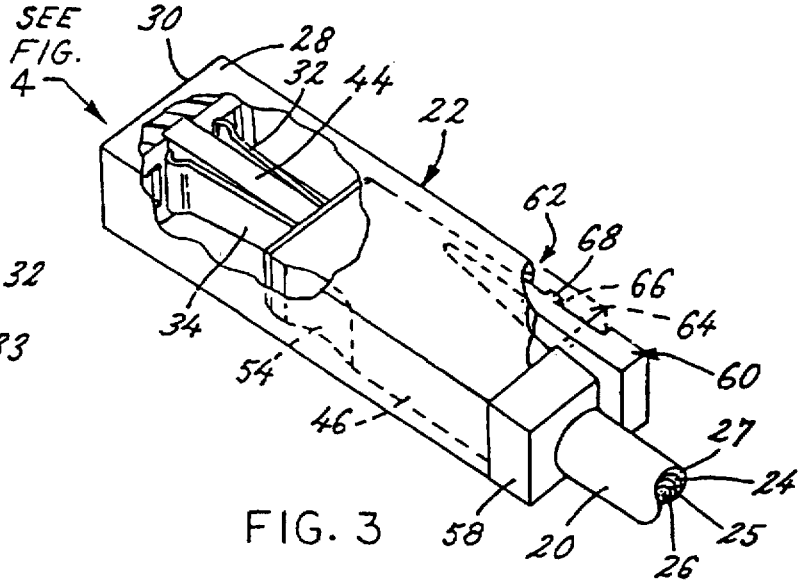
FIG. 3 is a partial cut-away, perspective view illustrating the terminating connector coupled to one end of a cable via a subassembly latched in a housing.
Figure 5:
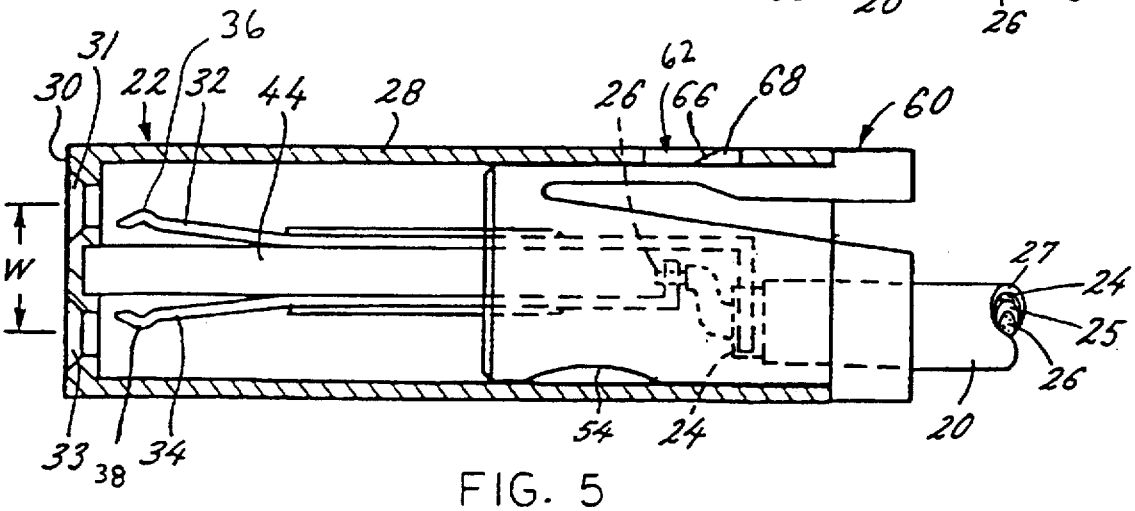
FIG. 5 is a side view of the terminating connector in partial cross-section showing the subassembly latched in the housing.
Figure 10:
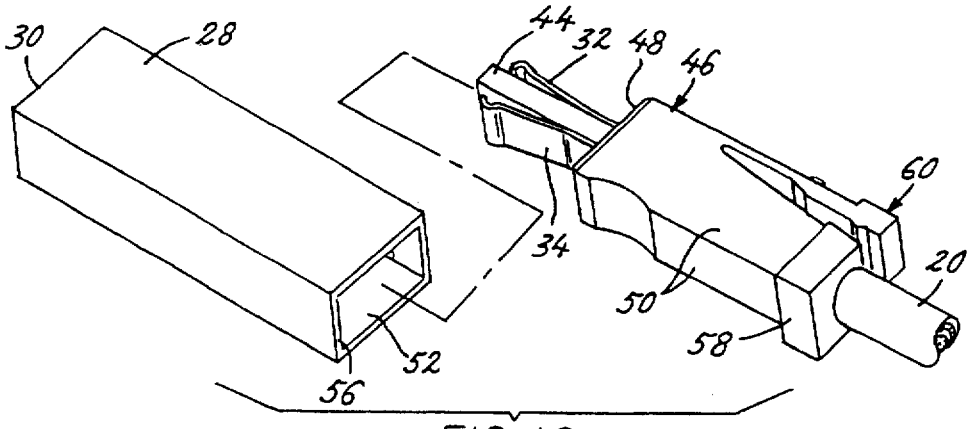
FIG. 10 is a perspective view showing the subassembly unlatched from the housing.
Figure 11:
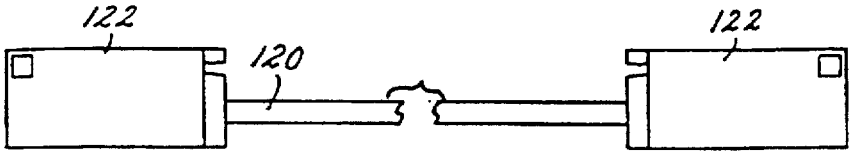
FIG. 11 is a side view simila r to FIG. 1 illustrating an alternate data transmission apparatus having multiple signal-carrying conductors within the cable.
Figure 12:
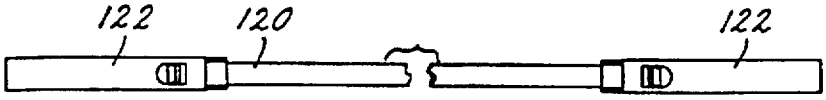
FIG. 12 is a top view of the apparatus of FIG. 11.
Figure 14:
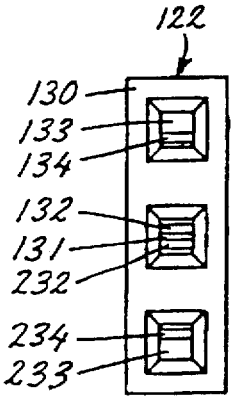
FIG. 14 is an end view illustrating apertures in the housing for providing electrical access to the terminals of the connector of FIGS. 11–13.

As best shown in FIGS. 3, 5 and 10, the components of each connector are surrounded by a protective housing 28, the housing 28 adapted for plugging into a backplane assembly or the like (not shown). The housing 28 may be made from molded plastic or other suitable material. A mating end 30 of the housing 28 includes two openings 31, 33 (FIG. 4) providing access to first and second terminals 32, 34 of the connector 22, such that complementary terminals or the like of a backplane connector may mate therewith.

As best shown in FIG. 5, the first and second terminals 32, 34 are resilient at respective contact points 36, 38 thereof so as to be deflectable by such complementary terminals, thereby ensuring adequate electrical contact. As also shown, the other end 40 of the first terminal 32 is electrically coupled to the shield 24 while the other end 42 of the second terminal 34 is electrically coupled to the signal carrying conductor 26 of the cable.

In accordance with one aspect of the invention, as shown in FIGS. 3 and 5, the first and second terminals 32, 34 have a dielectric insert 44 sandwiched therebetween. The dielectric insert 44 is dimensioned and has a dielectric constant selected such that the impedance through the connector 22 substantially matches the impedance of the cable 20. The separation and area of the terminals adjacent the dielectric insert 44, along with the dielectric constant of the dielectric insert 44, influence the characteristic impedance by generally altering the connector capacitance, i.e., ($C=\epsilon A/d$) where e is the dielectric permittivity, A is the common area of the terminals and d is the separation between the terminals).

One material found suitable for the dielectric insert 44 is RT Duroid, wherein the connector 22 is constructed to terminate a 50 ohm impedance cable and is a two millimeter (0.078±0.001 inches) type, i.e., as specified by the terminal separation W as shown in FIGS. 4 and 5. In such a connector, the thickness of the insert is 0.762 millimeters (0.030±0.001 inches). Other materials, including ceramics, have been found to provide desired impedances for this size connector, although ceramics are generally less durable. Of course, alternate materials are feasible, as determined by the desired impedance and the dimensions of the connector.

For structural purposes, and particularly to provide strain relief for the cable 20, the cable end 21, terminals 32, 34 and dielectric insert 44 are overmolded into a subassembly 46 as best shown in FIG. 10. The subassembly 46 is dimensioned such that one end 48 of its outer surface 50 fits into the inner portion 52 of the tubular dielectric housing 28. A recess 54 may be optionally formed in the subassembly 46 to facilitate proper insertion. The housing 28 is open at one end 56, and the subassembly 46 includes a wider end portion 58 which limits the depth of insertion into the housing 28 from that end. As can be appreciated, this enables the terminals 32, 34 to be in the proper position (with respect to insertion depth) for making subsequent electrical contact.

To secure the subassembly 46 to the housing 28, as shown in FIG. 5, the subassembly 46 is molded with a resilient latch mechanism 60 for mechanically latching with a complimentary mechanism 62 in the housing 28. The latch mechanism 60 of the subassembly 46 is arranged to resiliently deflect during insertion or withdrawal into the housing 28. In the embodiments illustrated herein, the housing wall 64 contains a complimentary recess 66 or the like into which a projecting detent 68 on the deflected resilient latch 60 will spring upon full insertion of the subassembly 46 into the housing 28. Of course, alternative types of mechanical mechanisms that allow the subassembly 46 to be secured to the housing 28 are feasible. In addition, other methods of securing the subassembly 46 to the housing 28 provide acceptable results, such as described in copending U.S. patent application Ser. No. 08/730,526 filed Oct. 11, 1996 entitled "Impedance Matched Cable Assembly" assigned to the assignee and having the same inventors as named herein.

To construct the connector 22, the terminals 32, 34 are stamped, formed and trimmed from sheet metal 69 as shown in FIGS. 6 and 7. The terminals 32, 34 are also typically plated as desired. Such stamping, forming, trimming and plating operations are well understood, and are not discussed in detail herein. During assembly, the trimming is such that the two terminals 32, 34 remain temporarily connected to one another by a sheet metal tab 70, shown in FIGS. 6 and 7 and in phantom in FIG. 8. Such a connection facilitates assembly by keeping the terminals 32, 34 aligned with one another at a desirable separation distance.

For simplicity, the connector 22 will be described from the perspective of having a forward end that plugs into a backplane, and a rearward end that is electrically coupled to the cable 20. Similarly, the prepared (stripped) end of the cable 21 may be considered the forward end of the cable, i.e., the forward end of the cable is electrically coupled to the rearward end of the connector 22. Of course, the forward and rearward terminology is arbitrary and does not limit the invention, as the apparatus may be oriented in any direction with signals being transmitted either or both directions therethrough.

As shown in FIG. 8, the forward end 21 of the cable 20 is prepared, i.e., stripped in a known manner, such that the center, signal carrying conductor 26 extends foremost, with a portion of its insulated layer 25 extending to a lesser distance to insulate the signal carrying conductor 26 from the stripped braided portion 24. The braided shield 24 is then electrically coupled, e.g., soldered or welded, to the rearward end of the first terminal 32, while the center, signal-carrying conductor 26 is electrically coupled, e.g., soldered, welded or crimped to the second terminal 34. In the exemplified embodiment shown herein, the first terminal 32 has a C-shaped portion adapted to fit around the braided shield 24 to facilitate the soldering or welding. Similarly, the second terminal 34 has an O-shaped opening through which the center conductor 26 is inserted prior to soldering or welding.

In another step, as represented in FIG. 8, the dielectric insert 44 is inserted between the terminals 32, 34. The resiliency and separation of the terminals may be such that the insert is held in place, however this is not necessary to the invention. When assembled, the tab 70 shown in phantom in FIG. 8 is removed, such that at this moment the connector generally appears as in FIG. 9. The terminals 32, 34, insert 44 and cable end 21 are then overmolded into the subassembly 46 shown in FIG. 10. Lastly, when cured, the subassembly 46 is inserted into the housing 28 wherein it latches as described above.

While the housing 28 is shown as having one opening for receiving the subassembly 46, the housing may include a plurality of openings each arranged to receive a subassembly 46.

Finally, as best shown in FIGS. 11–14, similar connectors 122 may be arranged for terminating cables 120 having multiple signal carrying conductors 126, 226. for simplicity, in FIGS. 11–14, like components performing like functions to those in FIGS. 1–10 are numbered exactly one-hundred higher than their numbered counterparts of FIGS. 1–10. Where necessary in FIGS. 11–14, when two such like components are provided instead of one, each of the second such components are numbered exactly two-hundred higher than their numbered counterparts in FIGS. 1–10.

Figure 13:
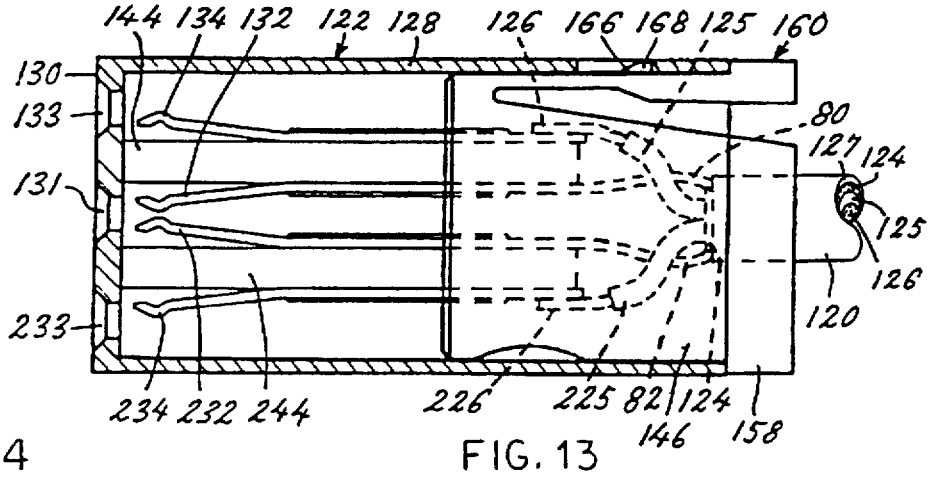
FIG. 13 is a partial cut-away, perspective view illustrating a terminating connector with multiple signal carrying conductors of FIGS. 11–12.

Thus, as shown in FIG. 13, the braided shield 124 may be coupled to common terminals 132, 232 for mating with a single complementary terminal of a suitable complementary backplane connector. To this end, wire-like leads 80, 82 or the like may be used to facilitate the connection. Of course, the shield 124 may only be coupled to one of the two terminals, and only one such ground terminal may be actually necessary (e.g., terminal 132). Similarly, such a connector may provide two separate terminals for contacting the shield, i.e., have four separate contact points.

In any event, the center conductors 126, 226 are electrically coupled to the terminals 134, 234, respectively. A first dielectric insert 144 is inserted between terminals 132 and 134, while a second dielectric insert 244 is inserted between terminals 232 and 234. In the manner described above, the cable end, dielectric inserts 144, 244 and terminals 132, 232, 134 and 234 are overmolded into a latching subassembly 146. As before, the subassembly 146 is inserted into and latched with an appropriately-configured housing 128. As can be appreciated, the housing 128 provides as many openings 131, 133 and 233 as necessary to provide access to the multiple terminals.

Note that in FIG. 13 the terminals 132, 232, 134 and 234 are not shown as being bent for electrical coupling to the prepared end of the cable 120 in the same manner as in FIG. 3. However, the shape of the terminal is not necessary to the invention, and the connector functions satisfactorily with terminals having this alternative, flat shape.

In an alternate embodiment the dielectric insert 44 may be molded with the housing 28 and not with the subassembly 46. The insert 44 will then be positioned between the terminals 32 and 34 when the subassembly including the two terminals is inserted into the housing.

As can be seen from the foregoing detailed description, there is provided an apparatus and method that improves the integrity of signal transmission by improving the impedance match between an electrical terminating connector and a data transmission cable terminated thereby. The terminating connector substantially matches the impedance of the cable, and the connector is compatible in size and shape with standardized connector specifications. The apparatus employs a relatively simple and economical manufacturing method, and provides a sturdy and reliable connector.

We claim:

1. An electrical terminating connector for an electrical signal transmission cable, the cable of a known characteristic impedance and of the type having a signal carrying conductor and a shield, the connector comprising, a subassembly including a first terminal arranged for electrically coupling at one end thereof to the shield and having a first contact at an opposite end thereof, a second terminal arranged for electrically coupling at one end thereof to the signal carrying conductor and having a second contact at an opposite end thereof, a dielectric insert disposed between the first and second terminals, the dielectric insert being dimensioned and having a selected dielectric properties to provide a characteristic impedance of the subassembly that substantially matches the characteristic impedance of the cable, and a latch mechanism, and an electrically conductive housing, the housing having an interior region dimensioned to receive the subassembly from one end of the housing such that the first and second contacts are electrically accessible from an opposite end of the housing, and the housing including a complimentary latch mechanism in the interior region for latching with the latch mechanism of the subassembly wherein the subassembly is overmolded into a unitary structure.

2. The connector of claim 1 wherein the dielectric insert comprises RT Duroid.

3. The connector of claim 1 wherein the dielectric insert comprises ceramic material.

4. The connector of claim 1 wherein the latch mechanism of the subassembly includes a resilient member having a projection thereon, and the latch mechanism of the housing includes a recess for engaging the projection.

5. The connector of claim 1 wherein the cable has a plurality of signal carrying conductors, and further comprising a third terminal arranged for electrically coupling at one end thereof to a second signal carrying conductor and having a third contact at an opposite end thereof.

6. An apparatus for transmitting electrical signals therethrough, comprising:

a transmission cable of a known characteristic impedance, the cable including a signal carrying conductor and a shield; and an electrical terminating connector, the connector comprising, a subassembly including a first terminal electrically coupled at one end to the shield and having a first contact at an opposite end thereof, a second terminal electrically coupled at one end to the signal carrying conductor and having a second contact at an opposite end thereof, a dielectric insert disposed between the first and second terminals, the dielectric insert being dimensioned and having selected dielectric properties to provide a characteristic impedance of the subassembly that substantially matches the characteristic impedance of the cable, and a latch mechanism, and an electrically conductive housing, the housing having an interior region dimensioned to receive the subassembly from one end of the housing such that the first and second contacts are electrically accessible from an opposite end of the housing, and the housing including a complimentary latch mechanism in the interior region for latching with the latch mechanism of the subassembly wherein the subassembly is overmolded into a unitary structure.

7. The apparatus of claim 6 wherein the dielectric insert comprises RT Duroid.

8. The apparatus of claim 6 wherein the dielectric insert comprises ceramic material.

9. The apparatus of claim 6 wherein the latch mechanism of the subassembly includes a resilient member having a projection thereon, and the latch mechanism of the housing includes a recess for engaging the projection.

10. The apparatus of claim 6 wherein the cable has a plurality of signal carrying conductors, and further comprising a third terminal arranged for electrically coupling at one end thereof to a second signal carrying conductor and having a third contact at an opposite end thereof.

11. A method of constructing an apparatus for transmitting electrical signals therethrough, comprising the steps of, providing a transmission cable of a known characteristic impedance, the cable including a signal carrying conductor and a shield, electrically coupling a first terminal at one end thereof to the shield, electrically coupling a second terminal at one end thereof to the signal carrying conductor, inserting a dielectric material between the first and second terminals, the dielectric material being dimensioned and having selected dielectric properties to provide a characteristic impedance of the subassembly that substantially matches the characteristic impedance of the cable, overmolding the dielectric insert, the end of the first terminal coupled to the shield, and the end of the second terminal coupled to the signal carrying conductor into a subassembly, and inserting the subassembly into an electrically conductive housing.

12. The method of claim 11 wherein the step of overmolding the subassembly includes the step of providing a latch mechanism in the subassembly, and the step of inserting the subassembly into the housing includes the step of latching the subassembly to the housing.

13. The method of claim 11 wherein the cable has a plurality of signal carrying conductors, and further comprising the step of electrically coupling a third terminal at one end thereof to a second signal carrying conductor.

14. The method of claim 11 further comprising the step of stripping the cable such that the signal carrying conductor and shield are exposed for electrically coupling to the respective terminals.

15. The method of claim 11 further comprising the steps of stamping and forming the first and second terminals.

16. An electrical terminating connector for an electrical signals transmission cable, the cable of a known characteristic impedance and of the type having a signal carrying conductor and a shield, the connector comprising, a subassembly including a first terminal arranged for electrically coupling at one end thereof to the shield and having a first contact at an opposite end thereof, a second terminal arranged for electrically coupling at one end thereof to the signal carrying conductor and having a second contact at an opposite end thereof, the first and second terminals separated by a predetermined distance, an electrically conductive housing, the housing having an interior region dimensioned to receive the subassembly from one end of the housing such that the first and second contacts are electrically accessible from an opposite end of the housing, wherein the subassembly is overmolded into a unitary structure, a dielectric insert disposed within said interior region of the housing such that it is located between the first and second terminals when the subassembly is inserted into the housing, the dielectric insert being dimensioned and having selected dielectric properties to provide a characteristic impedance of the subassembly that substantially matches the characteristic impedance of the cable, and a latch mechanism, and the housing including a complimentary latch mechanism in the interior region for latching with the latch mechanism of the subassembly.

* * * * *